United States Patent [19]

Hayakawa et al.

[11] Patent Number: 4,475,962

[45] Date of Patent: Oct. 9, 1984

[54] ANNEALING METHOD FOR AMORPHOUS MAGNETIC ALLOY

[75] Inventors: Masatoshi Hayakawa, Chigasaki; Koichi Aso, Yokohama; Satoru Uedaira, Yokohama; Yoshitaka Ochiai, Yokohama; Hideki Matsuda, Yokohama; Kazuhide Hotai, Sendai; Kazuhiko Hayashi, Yokohama, all of Japan

[73] Assignee: Sony Corporation, Tokyo, Japan

[21] Appl. No.: 511,645

[22] Filed: Jul. 7, 1983

[30] Foreign Application Priority Data

Jul. 8, 1982 [JP] Japan ..... 57-119013
Jul. 15, 1982 [JP] Japan ..... 57-123490

[51] Int. Cl.[3] ..... C21D 1/04
[52] U.S. Cl. ..... 148/108; 148/31.55
[58] Field of Search ..... 148/108, 31.55

[56] References Cited

U.S. PATENT DOCUMENTS

| | | | |
|---|---|---|---|
| 4,116,728 | 9/1978 | Becker et al. | 148/108 |
| 4,268,325 | 5/1981 | O'Handley et al. | 148/108 |
| 4,312,683 | 1/1982 | Sakakima et al. | 148/108 |
| 4,379,004 | 5/1983 | Makino et al. | 148/108 |

FOREIGN PATENT DOCUMENTS

| | | | |
|---|---|---|---|
| 56-44746 | 4/1981 | Japan | 148/108 |
| 56-69360 | 6/1981 | Japan | 148/108 |
| 57-114646 | 7/1982 | Japan | 148/108 |
| 2088415 | 6/1982 | United Kingdom | 148/108 |

*Primary Examiner*—John P. Sheehan
*Attorney, Agent, or Firm*—Hill, Van Santen, Steadman & Simpson

[57] ABSTRACT

Annealing method for an amorphous magnetic alloy including the steps of preparing an amorphous magnetic alloy film, and annealing the amorphous magnetic alloy film at an elevated temperature lower than Curie temperature and crystallization temperature of the amorphous magnetic alloy film under an application of a repetition of alternately applied a first magnetic field and a second magnetic field, in which the first magnetic field is applied along one direction in a major surface of the amorphous magnetic alloy film for a predetermined period, and the second magnetic field is applied along a second direction perpendicular to the one direction in the major surface of the amorphous magnetic alloy film for the predetermined period.

8 Claims, 16 Drawing Figures

1
Ha
Kx
Ky

ANNEALING METHOD FOR AMORPHOUS MAGNETIC ALLOY

BACKGROUND OF THE INVENTION

1. Field of the Invention

This invention relates generally to an annealing method for an amorphous magnetic alloy and more particularly is directed to an annealing method for improving the permeability of the amorphous magnetic alloy.

2. Description of the Prior Art

Magnetic characteristics required by a soft magnetic material core such as a magnetic transducer head and so on are not only high permeability in the frequency band to be used but also high saturation magnetic flux density, magnetostriction of approximately zero and so on. Co-Fe-Si-B-based material mainly containing Co is well known as the amorphous magnetic material which can satisfy such requirements. Also, it is well known that, if the alloy is kept at a temperature higher than Curie temperature and lower than crystallization temperature and then quenched, the permeability thereof can be improved more. On the other hand, it is possible that the total amount of (Co+Fe) of the Co-Fe-Si-B-based amorphous magnetic material as described above is increased, the saturation magnetic flux density thereof can be raised. However, as shown in FIG. 1, as the total amount of (Co+Fe) increases, the permeability of the amorphous magnetic material as made is low so that it is difficult to provide particularly a magnetic transducer head for recording and/or playback audio signal or the like amorphous magnetic material in practice. Hence, a method for improving the permeability thereof is required. However, since the crystallization temperature $T_x$ of the Co-Fe-Si-B-based amorphous magnetic material is lowered as the total amount of (Co+Fe) increases and is further lowered than the Curie temperature $T_c$ when the total amount of (Co+Fe) is about 78 atomic %, the annealing by quenching the material from an elevated temperature higher than the Curie temperature $T_c$ can not be used. Resultantly, the saturation magnetic flux density of the composition the permeability of which can be improved by the afore-described annealing method is approximately 9000 Gauss at maximum. Thus, it is impossible to provide such a magnetic transducer head which can sufficiently utilize the magnetic characteristics of a magnetic recording medium having high coercive force such as a metal or alloy magnetic tape.

OBJECTS AND SUMMARY OF THE INVENTION

It is an object of the present invention to provide an improved annealing method for an amorphous magnetic alloy.

It is another object of the present invention to provide an annealing method to improve the permeability of an amorphous magnetic alloy.

It is a further object of the present invention to provide an annealing method to improve the permeability of an amorphous magnetic alloy having high saturation magnetic flux density.

It is a still further object of the present invention to provide an annealing method to improve the permeability of an amorphous magnetic alloy independent on the relation between Curie temperature and crystallization temperature of an amorphous magnetic alloy.

According to one aspect of the present invention, there is provided an annealing method for an amorphous magnetic alloy comprising the steps of:

(a) preparing an amorphous magnetic alloy film; and (b) annealing said amorphous magnetic alloy film at an elevated temperature lower than Curie temperature and crystallization temperature of said amorphous magnetic alloy film under an application of a repetition of alternately applied a first magnetic field and a second magnetic field, said first magnetic field being applied along one direction in a major surface of said amorphous magnetic alloy film for a predetermined period, and said second magnetic field being applied along a second direction perpendicular to said one direction in said major surface of said amorphous magnetic alloy film for said predetermined period.

The other objects, features and advantages of the present invention will become apparent from the following description taken in conjunction with the accompanying drawings through which the like references designate the same elements and parts.

DESCRIPTION OF THE PREFERRED EMBODIMENTS

Figure 1:
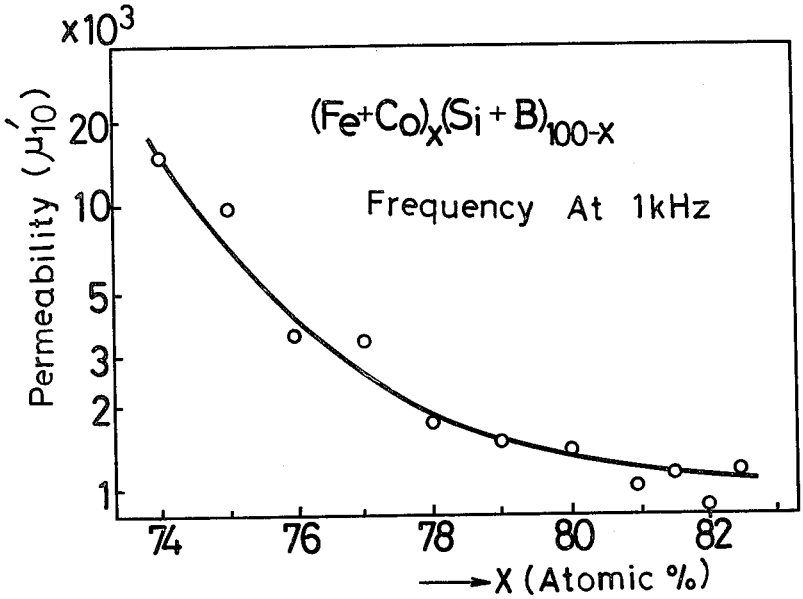
FIG. 1 is a characteristic graph showing change of the permeability of Co-Fe-Si-B-based amorphous magnetic alloy relative to the (Fe+Co) amount thereof.
Figure 2:
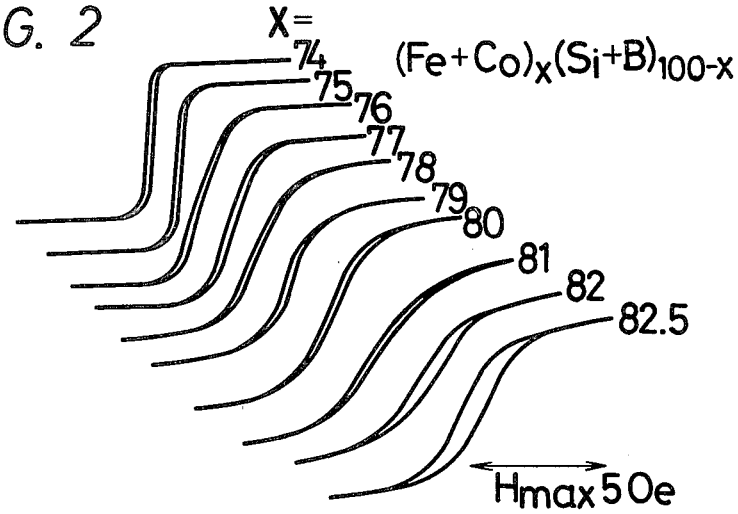
FIG. 2 is a graph showing A.C. B-H loop of each composition $(Fe+Co)_x(Si+B)_{100-x}$.

As was shown in FIG. 1, in the Co-Fe-Si-B-based amorphous magnetic alloy, the permeability thereof is lowered as the amount of (Co+Fe) therein increases. Meanwhile, FIG. 2 shows an A.C. B-H loop of each of corresponding compositions $(Fe+Co)_x(Si+B)_{100-x}$. The A.C. B-H loop increases its inclination as the amount of (Co+Fe) increases and this reveals that magnetic anisotropy induced upon manufacturing the amorphous magnetic material increases as the amount of (Co+Fe) increases. It is considered that the existence of the induced magnetic anisotropy causes the composition region having particularly large amount of (Co+Fe) to have not so large permeability. Although the induced magnetic anisotropy is erased by keeping once the amorphous magnetic alloy at a temperature higher than the Curie temperature $T_c$ and by quenching so that the permeability of the amorphous magnetic alloy can be improved greatly, it can not be applied to the composition having the Curie temperature $T_c$ higher than the crystallization temperature.

Figure 3:
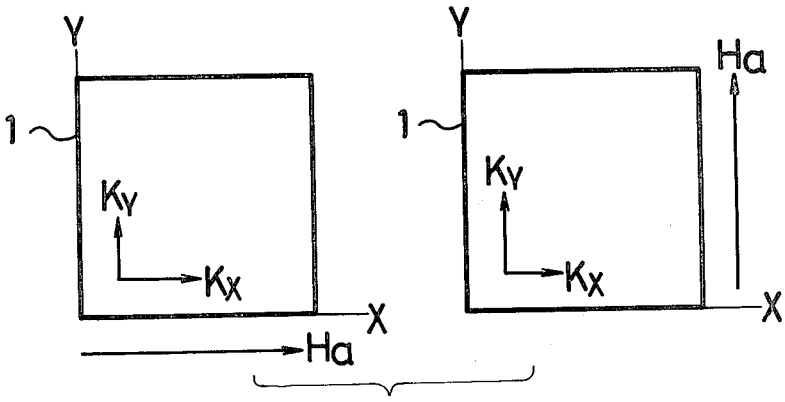
FIG. 3 is a diagram showing the state of how magnetic anisotropy is induced when an external magnetic field is applied to the amorphous magnetic alloy.

The amorphous magnetic alloys of these bases all exhibit field cooling effect. In other words, if the annealing treatment is performed in the magnetic field, uniaxial magnetic anisotropy is induced newly in the direction of applied magnetic field so that the induced magnetic anisotropy existing upon manufacturing is erased. The direction of the induced magnetic anisotropy at that time is not changed even if the direction of the external magnetic field is inverted by 180°. However, as shown in FIG. 3, while an amorphous magnetic alloy thin film or sheet 1 is applied with an external magnetic field Ha in the X-direction, the annealing treatment is carried out therefor at a temperature lower than the crystallization temperature and also the Curie temperature of the alloy to thereby generate therein a sufficient induced magnetic anisotropy $K_x$ in the X-direction. Thereafter, the magnetic field in the X-direction is removed, the amorphous magnetic alloy thin sheet 1 is again applied with the external magnetic field Ha in the Y-direction accurately perpendicular to the X-direction and subjected to the annealing treatment. Then, the induced magnetic anisotropy $K_x$ in the X-direction is decreased, while the induced magnetic anisotropy $K_y$ in the Y-direction is generated. It is known that the relation expressed by the following equation (1) is established between the permeability $\mu$ and the magnitude $K_u$ of the induced magnetic anisotropy.

$$\mu \propto 1/K_u \text{ or } \mu \propto 1/\sqrt{K_u} \quad (1)$$

Accordingly, in order to increase the permeability $\mu$, the induced magnetic anisotropy $K_u$ must be decreased. The $K_u$ in the equation (1) is determined by a difference between the induced magnetic anisotropy $K_x$ in the X-direction and the induced magnetic anisotropy $K_y$ in the Y-direction.

$$K_u = |K_x - k_y| \quad (2)$$

Consequently, in the process in which the induced magnetic anisotropy shown in FIG. 3 performs the increase-decrease while changing its direction by 90°, at the instant the following condition $$K_x \cong K_y \quad (3)$$

is satisfied, the $K_u$ becomes zero so that the large permeability $\mu$ is obtained in theory. However, although it is theoretically possible to satisfy the condition, $K_x \cong K_y$ by applying once along the Y-direction the external magnetic field to the amorphous alloy film having magnetic anisotropy once induced along the X-direction, it is difficult to industrially reproduce the induced magnetic anisotropy.

Figures 4A, 4B, 4C, 4D, 4E, 4F, 4G:
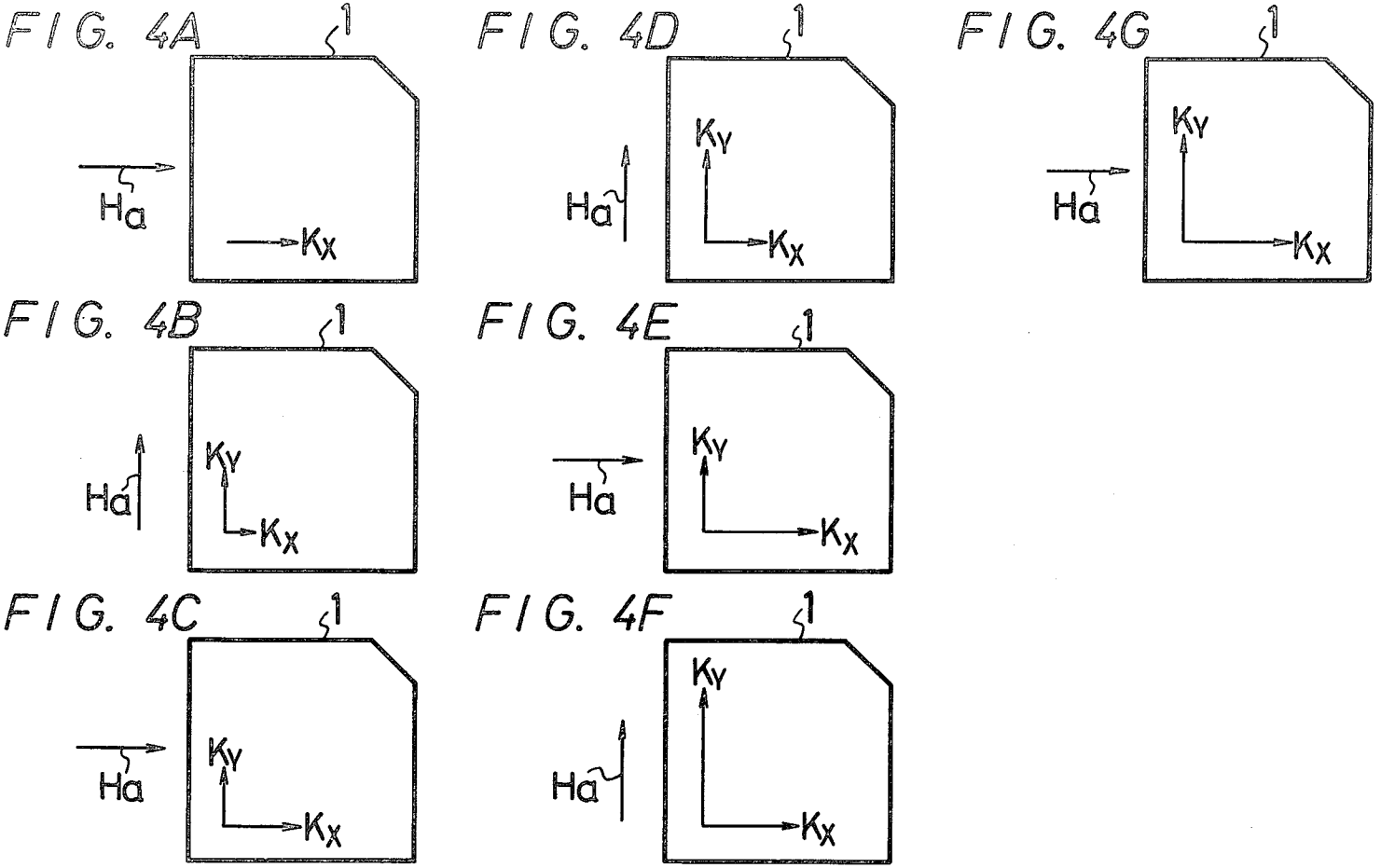
FIGS. 4A to 4G are respectively diagrams showing the state of the induced magnetic anisotropy changing with time in the annealing method of this invention.

Therefore, in this invention, such an annealing is carried out that while applying the magnetic field to the amorphous magnetic alloy thin film alternately along the X-direction within the major surface of the thin film and the Y-direction perpendicular thereto for the same period of time each at a temperature lower than the crystallization temperature and the Curie temperature of the magnetic alloy. As a result, as schematically illustrated in FIGS. 4A to 4G, as time goes by, the induced magnetic anisotropies $K_x$ and $K_y$ of substantially the same magnitude are grown in the X- and Y-directions so that the induced magnetic anisotropy existing upon manufacturing is decreased to thereby satisfy the condition, $K_x \cong K_y$. An arrow Ha in FIG. 4 represents the direction along which the magnetic field is applied. It takes a finite time (relaxation time $\tau$) for the induced magnetic anisotropy to increase or decrease after having been applied with the magnetic field. Then, if the time for the magnetic field to be changed from the X-direction to the Y-direction is shorter enough than the relaxation time $\tau$, the condition, $K_x \cong K_y$ is always established. This relaxation time $\tau$ can be obtained by the measurement according to a well-known torque method.

The fundamental prinsiple of the present invention is described as above, and what is essentially important is to keep the magnetic field, which is applied in the X- and Y-directions, for a finite time.

Consequently, this invention is different from a conventional method in which the amorphous magnetic alloy film or sheet is continuously rotated in the magnetic field or it is subjected to the annealing treatment in the magnetic field which is being continuously rotated so that the induced magnetic anisotropy is distributed in the isotropic manner.

According to such conventional method, when a composite magnetic field is rotated at least 180°, the induced magnetic anisotropy becomes isotropic macroscopically. However, when the composite magnetic field is rotated 180°, the direction of the induced magnetic anisotropy becomes the same as that of the initial state so that the isotropic distribution of the induced magnetic anisotropy can not be expected.

Consequently, according to the present invention the annealing treatment is performed on the basis of the afore-said fundamental principle. More specifically, the annealing treatment is performed while keeping the amorphous magnetic alloy thin film at a temperature lower than the crystallization temperature thereof and the Curie temperature thereof alternately applying thereto the external magnetic fields, each of which is different in direction by exactly 90° or changing (swinging) intermittently or continuously the direction of the above thin film by exactly 90° in the magnetic field of one direction. Such annealing treatment will hereinafter be called switching cross field anneal.

Thus, the induced magnetic anisotropy existing upon manufacturing is decreased, while satisfying the condition, $k_x \cong K_y$. In consequence, free from the relation between the crystallization temperature $T_x$ and the Curie temperature $T_c$, the permeability of the general amorphous magnetic alloy presenting field cooling effect can be raised and even the permeability of particularly the composition having the saturation magnetic flux density of 10000 Gauss or more can be raised.

Furthermore, in this invention, in addition to the afore-said switching cross field anneal, another annealing treatment may be performed under the condition that the perpendicular magnetic field is applied to the major surface of the amorphous magnetic alloy thin film (this annealing treatment will hereinafter be called normal field anneal). The normal field anneal is also carried out under a temperature lower than the Curie temperature and the crystallization temperature of the amorphous magnetic alloy.

According to the normal filed anneal, the induced magnetic anisotropy existing in the major surface is decreased and the direction thereof is changed to the thickness direction of the amorphous magnetic alloy ribbon, thus increasing the permeability in the major surface.

When the two annealing treatments of the switching cross field anneal and the normal field anneal are performed, it is possible to increase the permeability in particularly the high frequency band region.

The amorphous magnetic alloy, which will be annealed in the present invention, can be made by, for example, liquid quench and sputtering. The liquid quench is such a method that a melt formed from melting the alloy of a desired combination is quenched on the surface of the roll being rotated at high speed. In this invention, however, the method of producing the amorphous alloy is not important.

Now, examples of the present invention will be described.

COMPARATIVE EXAMPLE 1

Figure 5:
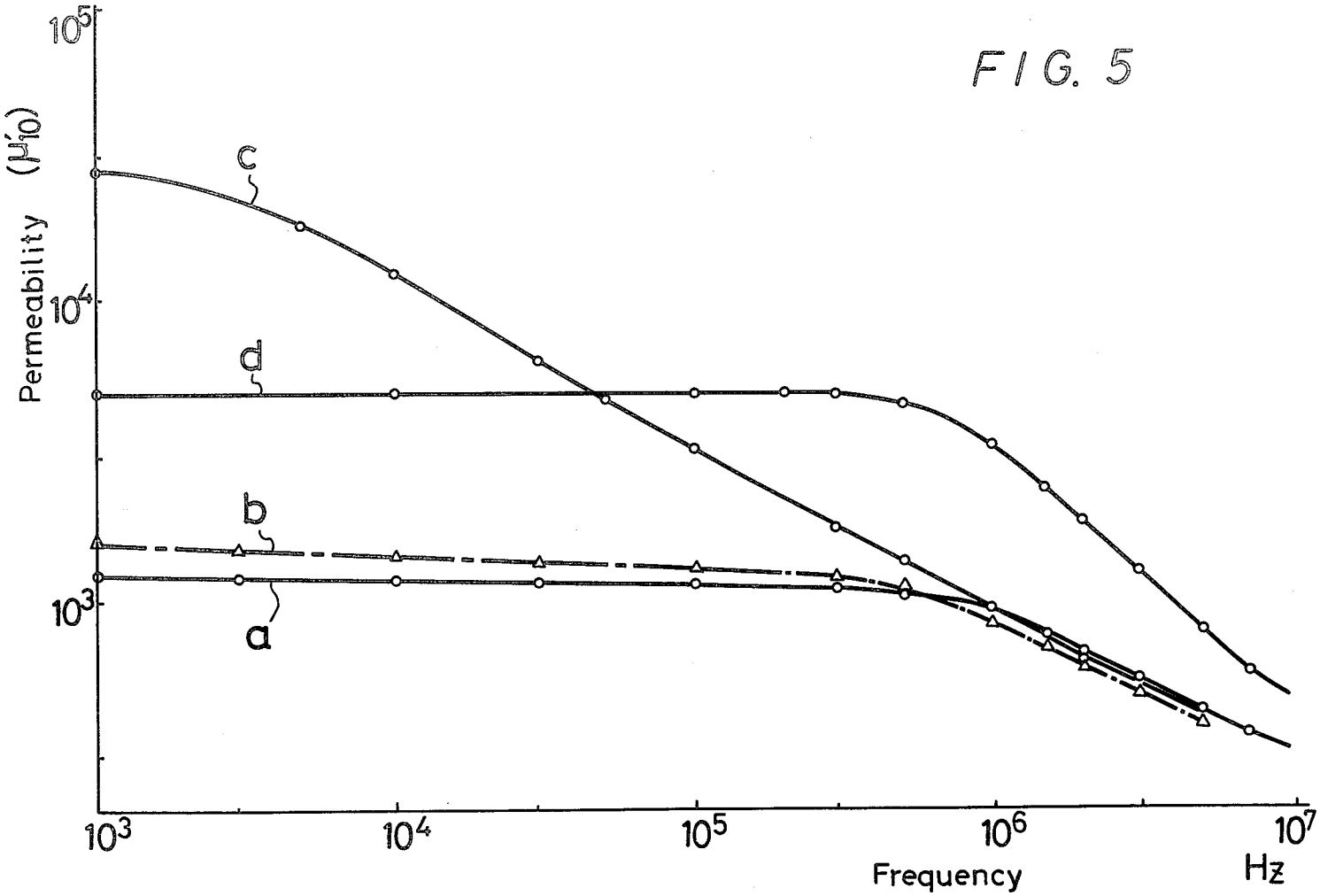
FIG. 5 is a graph showing permeability improved by the annealing method according to this invention.

An annular sample of 10 mm in outer diameter and 6 mm in inner diameter was punched out from an amorphous magnetic alloy ribbon having the composition, $Fe_5Co_{75}Si_4B_{16}$ made by liquid quench. Then, the permeability of the sample as made under the excitation magnetic field of 10 m Oe was measured. Maxwell Bridge was used in the measurement of the permeability. A curve a in FIG. 5 indicates measured results of the permeability in each frequency.

COMPARATIVE EXAMPLE 2

A square sheet, 2.5 cm by 2.5 cm was cut out from the same amorphous magnetic alloy ribbon as that of the comparative example 1 and held by a holder made of copper. While applying the magnetic field of one direction at 2.4 k Oe to this square sheet in parallel to the sheet surface thereof, the square sheet was kept at a temperature of 340° C. in an electric furnace for 10 minutes thus subjected to the annealing treatment. Thereafter, the same annular sample as described in the comparative example 1 was punched out from the square sheet and the permeability thereof was measured. A curve b in FIG. 5 indicates measured results of the permeability in each frequency.

EXAMPLE 1

A square sheet, 2.5 cm by 2.5 cm was cut out from the same amorphous magnetic alloy ribbon as that of the comparative example 1 and held by a holder made of copper. This holder was moved back and forth exactly 90° by a rotary actuator. A time during which the holder is stopped at the positions of zero degree and 90 degrees respectively was determined as about 0.5 seconds and a time during which it is swung between the position of zero degree and the position of 90 degrees was determined as about 0.2 seconds. Then, while heating the square sheet in the electric furnace, the magnetic field of the one direction having a magnitude of 2.4 k Oe was applied to the sheet in parallel to its sheet surface. The annealing was carried out for 10 minutes at a temperature of 345° C. Thereafter, under the application of the magnetic field to the sheet, the holder was continuously swung, and the temperature was lowered to the room temperature. Then, in the same way as in the comparative example, the annular sample was punched out from the sheet thus treated and the permeability thereof was measured. A curve c in FIG. 5 indicates measured results of the permeability in each frequency.

EXAMPLE 2

The amorphous magnetic alloy sheet having been subjected to the annealing treatment of the above example 1 was further subjected to the annealing treatment at 300° C. for 10 minutes in the electric furnace under the application of external magnetic field of 14 k Oe perpendicular to the major surface of the sheet. Thereafter, the same annular sample as described in the comparative example 1 was punched out from the sheet and the permeability thereof was measured. A curve d in FIG. 5 indicates measured results of the permeability in each frequency.

As will be clear from the afore-described comparative examples and the examples of the present invention, if the direction of the applied magnetic field is switched to by exactly 90° to thereby generate the induced magnetic anisotropy in the X- and Y-directions equally, the permeability can be improved significantly.

In the present examples, the significant improvements of the permeability according to the switching cross field anneal at 345° C. and the subsequent normal field anneal at 300° C. were recognized. These effects are achieved by utilizing the increase-decrease mechanism of the induced magnetic anisotropy, which can be applied to all the amorphous magnetic alloy having the field cooling effect if the temperature is at least 200° C. or more. In other words, in the case of the switching field anneal, the temperature is preferably selected as a temperature lower than the crystallization temperature, also the Curie temperature and in practice higher than 200° C. Further, the temperature in the subsequent normal field anneal is preferably selected as a temperature lower than the crystallization temperature, also the Curie temperature and in practice higher than 200° C. In any case, suitable annealing condition can be determined by selecting the temperature and the period of time of the annealing.

While in the example 2 the normal field anneal was carried out after the switching cross field anneal, the switching cross field anneal can be carried out after the normal field anneal.

Figure 6:
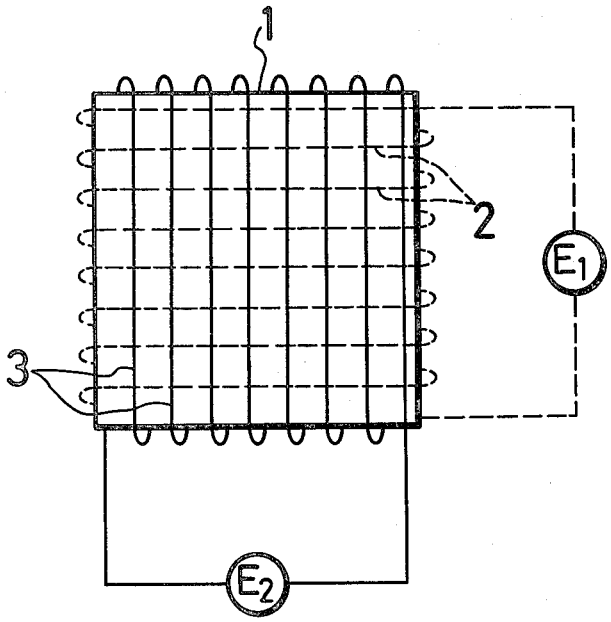
FIG. 6 is a schematic diagram showing an example of a practical annealing method of this invention.
Figure 7:
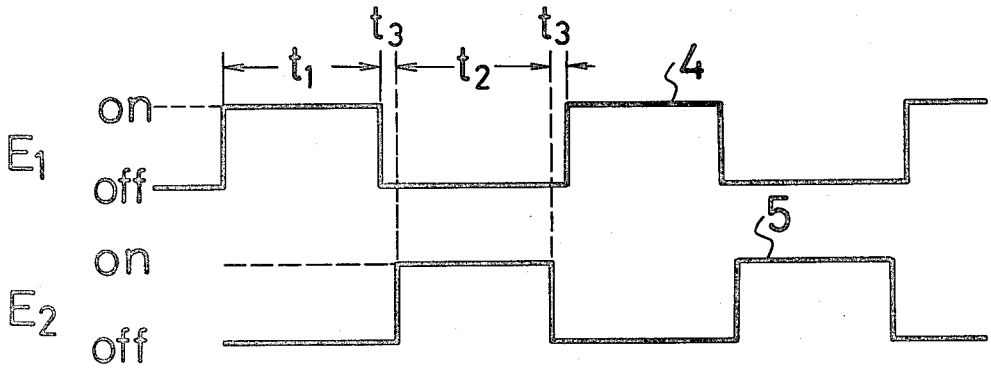
FIG. 7 is a timing waveform diagram showing currents to be applied to both coils used in FIG. 6.

In the examples as described above, the annealing treatment was carried out while swinging the amorphous magnetic alloy thin film between the first position and the second position perpendicular with each other in the fixed magnetic field of the one direction. Another example of the annealing method is shown in FIG. 6. In the example of FIG. 6, the annealing treatment is performed under such state that the amorphous magnetic alloy sample 1 is disposed within two coils 2 and 3 which are perpendicular to each other and the coils 2 and 3 are applied with currents from power sources $E_1$ and $E_2$ so as to alternately generate magnetic fields perpendicular to each other. In this case, the coils 2 and 3 are applied with the currents at timing waveforms shown by reference numerals 4 and 5 in FIG. 7 in which $t_1 = t_2 >> t_3$.

Figure 8:
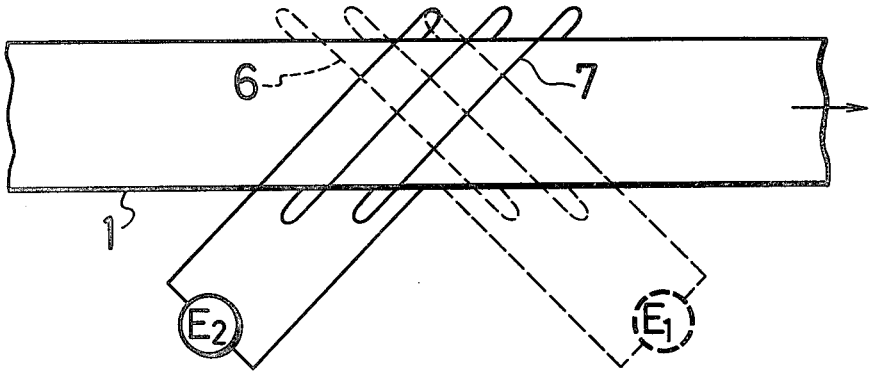
FIG. 8 is a schematic diagram showing another example of the practical annealing method of this invention.
Figure 9:
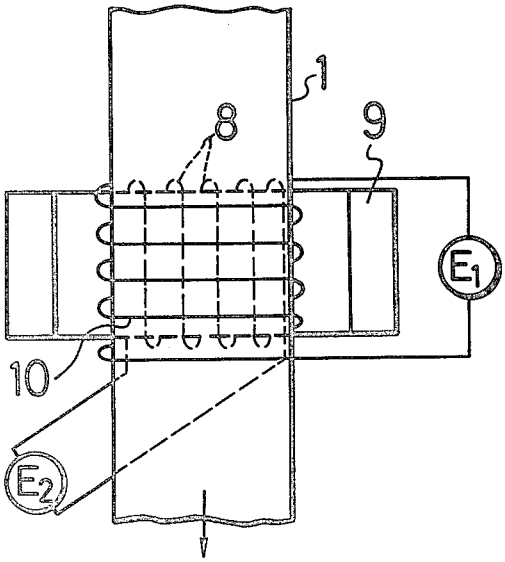
FIGS. 9 and 10 are respectively a schematic diagram showing further example of the practical annealing method of this invention and a cross-sectional diagram thereof.
Figure 10:
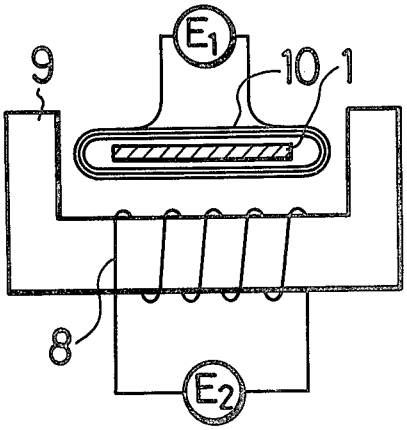

Furthermore, when the sample of continuous amorphous magnetic alloy ribbon is continuously annealed, annealing methods as, for example, shown in FIG. 8 or FIGS. 9 and 10 may be considered. In the case of the annealing method in FIG. 8, there are provided two coils 6 and 7 in the furnace for generating magnetic fields perpendicular to each other, the ribbon-like sample 1 is transported within the coils 6 and 7 and both the coils 6 and 7 are applied with currents from the current sources $E_1$ and $E_2$ at the same timing waveforms 4 and 5 as those of FIG. 7 whereby to perform the field annealing. In the case of FIGS. 9 and 10, in the furnace, there are provided an U-shape magnetic core 9 around which a first coil 8 is wound and a second coil 10 disposed within the magnetic core 9 to generate the magnetic field perpendicular to the direction of the magnetic field by the magnetic core 9, the ribbon-like sample 1 is transported within the magnetic core 9 and the second coil 10, and both the first and second coils 8 and 10 are alternately applied with currents from the current sources $E_2$ and $E_1$ whereby to perform the annealing. According to such annealing methods, the ribbon-like sample 1 can be annealed continuously.

As set forth above, this invention can be applied to the amorphous magnetic alloy in general presenting field cooling effect and the permeability of particularly the composition having the saturation magnetic flux density of 10000 Gauss or more can be raised. Thus, this invention can provide a soft magnetic material core excellent in the use of the magnetic transducer head and so on.

The above description is given on the preferred embodiments of the invention, but it will be apparent that many modifications and variations could be effected by one skilled in the art without departing from the spirits or scope of the novel concepts of the invention, so that the scope of the invention should be determined by the appended claims only.

I claim as my invention:

1. Annealing method for an amorphous magnetic alloy comprising the steps of:

(a) preparing an amorphous magnetic alloy film;

(b) annealing said amorphous magnetic alloy film at an elevated temperature lower than Curie temperature and crystallization temperature of said amorphous magnetic alloy film under a application of a cyclically applied first magnetic field and second magnetic field, said first magnetic field being applied along one direction in a major surface of said amorphous magnetic alloy film for a predetermined period, and said second magnetic field being applied after termination of said first magnetic field along a second direction perpendicular to said one direction in said major surface of said amorphous magnetic alloy film for said predetermined period.

2. Annealing method for an amorphous alloy comprising annealing an amorphous magnetic alloy film at an elevated temperature lower than Curie temperature and crystallization temperature of said amorphous magnetic alloy sheet under application of magnetic field of a combination of the following manners I and II, said manner I being an application of a cyclically applied first magnetic field and second magnetic field, said first magnetic field being applied along one direction in a major surface of said amorphous magnetic alloy film for a predetermined period, and said second magnetic field being applied after termination of said first magnetic field along a second direction perpendicular to said one direction in said major surface of said amorphous magnetic alloy film for said predetermined period, and said manner II being an application of a magnetic field perpendicular to said major surface of said amorphous magnetic alloy sheet.

3. Annealing method for an amorphous magnetic alloy according to claim 1, wherein said elevated temperature is selected as 200° C. or more.

4. Annealing method for an amorphous magnetic alloy according to claim 2, wherein said elevated temperature is selected as 200° C. or more.

5. Annealing method for an amorphous magnetic alloy according to claim 1, wherein said Curie temperature is selected to be higher than said crystallization temperature.

6. Annealing method for an amorphous magnetic alloy according to claim 2, wherein said Curie temperature is selected to be higher than said crystallization temperature.

7. Annealing method for an amorphous magnetic alloy according to claim 1, wherein a switching at which said first magnetic field is changed to said second magnetic field is carried out in time shorter than a relaxation time during which induced magnetic anisotropy of said amorphous magnetic alloy increases or decreases.

8. Annealing method for an amorphous magnetic alloy according to claim 2, wherein a switching at which said first magnetic field is changed to said second magnetic field is carried out in time shorter than a relaxation time during which induced magnetic anisotropy of said amorphous magnetic alloy increases or decreases.

* * * * *